US011251531B2

(12) United States Patent
Matsuura

(10) Patent No.: US 11,251,531 B2
(45) Date of Patent: Feb. 15, 2022

(54) ANTENNA DEVICE AND RADIO APPARATUS

(71) Applicant: NEC Platforms, Ltd., Kawasaki (JP)

(72) Inventor: Tatsuya Matsuura, Kanagawa (JP)

(73) Assignee: NEC Platforms, Ltd., Kanagawa (JP)

( * ) Notice: Subject to any disclaimer, the term of this patent is extended or adjusted under 35 U.S.C. 154(b) by 243 days.

(21) Appl. No.: 16/717,505

(22) Filed: Dec. 17, 2019

(65) Prior Publication Data

US 2020/0220269 A1 Jul. 9, 2020

(30) Foreign Application Priority Data

Jan. 4, 2019 (JP) ..... JP2019-000192

(51) Int. Cl.
*H01Q 1/38* (2006.01)
*H01Q 9/04* (2006.01)
*H01Q 1/48* (2006.01)

(52) U.S. Cl.
CPC ..... *H01Q 9/045* (2013.01); *H01Q 1/48* (2013.01)

(58) Field of Classification Search
CPC ..... H01Q 9/045; H01Q 1/48; H01Q 21/30
See application file for complete search history.

(56) References Cited

U.S. PATENT DOCUMENTS

2015/0288071 A1* 10/2015 Toyao ..... H01Q 5/328 343/700 MS

FOREIGN PATENT DOCUMENTS

| | | | |
|---|---|---|---|
| JP | 2015-046689 | A | 3/2015 |
| JP | 2016-131319 | A | 7/2016 |
| JP | 2018-129595 | A | 8/2018 |
| WO | 2014/073703 | A1 | 5/2014 |

OTHER PUBLICATIONS

Japanese Office Action for JP Application No. 2019-000192 dated May 11, 2021 with English Translation.

* cited by examiner

*Primary Examiner* — Dieu Hien T Duong
(74) *Attorney, Agent, or Firm* — Sughrue Mion, PLLC

(57) ABSTRACT

An antenna device includes first and second openings formed inside a GND plate, a first feed conductor formed from a first outer peripheral side, which is one of the outer peripheral sides of the first opening, to a second outer peripheral side, and supplied with AC power, a first split part formed in an opening region of the first opening, a first feed conductor formed from a third outer peripheral side, which is one of the outer peripheral sides of the second opening, to a fourth outer peripheral side, and supplied with the AC power common to the first feed conductor, and a second split part formed in an opening region of the second opening.

10 Claims, 14 Drawing Sheets

ANTENNA DEVICE AND RADIO APPARATUS

INCORPORATION BY REFERENCE

This application is based upon and claims the benefit of priority from Japanese patent application No. 2019-000192, filed on Jan. 4, 2019, the disclosure of which is incorporated herein in its entirety by reference.

TECHNICAL FIELD

The present disclosure relates to an antenna device and a radio apparatus, and particularly relates to, for example, an antenna device and a radio apparatus suitable for performing radio communication in a plurality of frequency bands.

BACKGROUND ART

Recently, radio apparatuses have been downsized, and printed boards inside radio apparatuses have been highly densely mounted. For this reason, it is required to improve arrangement flexibility and to achieve downsizing of antennas to be mounted on radio apparatuses. Furthermore, radio apparatuses have been required to perform radio communication in accordance with a plurality of different communication standards. Accordingly, antennas to be mounted on radio apparatuses are required to transmit and receive radio signals in a plurality of frequency bands (communication bands). In other words, antennas to be mounted on radio apparatuses are required to operate at a plurality of frequencies.

A technique related to antennas is disclosed in, for example, Japanese Unexamined Patent Application Publication No. 2018-129595. The technique is specifically described below with reference to FIG. 12.

FIG. 12 is a conceptual diagram showing a configuration example of an antenna device A10 in a related technique.

As shown in FIG. 12, in an antenna device A10, a rectangular opening 15 is formed inside a GND (ground; earth) plate 11, such as a printed board, so as not to be in contact with any of the outer peripheral sides of the GND plate 11. In addition, a parallel split-ring resonator 14 is formed in an opening region (inside) of the opening 15. The parallel split-ring resonator 14 constitutes a split-ring resonator antenna (SRR antenna).

In the parallel split-ring resonator 14, a split part 16 is arranged, in the opening region of the opening 15, from one side of the opening 15 to the other side facing the one side. In addition, a feed conductor 12 is formed, in the opening region of the opening 15, from the one side of the opening 15 to the other side facing the one side so as to be parallel to the split part 16. Here, a power feed part 13 is arranged on the other side (the lower side of the sheet) of the opening 15. Thus, the parallel split-ring resonator 14 is supplied with alternating current (AC) power from the power feed part 13 through the feed conductor 12.

Note that, the split part 16 constituted by, although the details are to be described, two conductors arranged in the opening region of the opening 15 so as to face each other, and two conductors connecting these two facing conductors to the one side of the opening 15 and to the other side facing the one side. The two conductors arranged so as to face each other form a split (or slit).

FIG. 13 is an enlarged view of the parallel split-ring resonator 14 provided to the antenna device A10. As shown in FIG. 13, the split part 16 formed in the opening region of the opening 15 is constituted by a first split-part conductor 16*a*, a second split-part conductor 16*b*, a third split-part conductor 16*c*, and a fourth split-part conductor 16*d*.

The first split-part conductor 16*a* and the second split-part conductor 16*b* are arranged near the center of the opening region of the opening 15 so as to face each other. The third split-part conductor 16*c* is arranged so as to connect the first split-part conductor 16*a* to the one side (the upper side of the sheet) of the opening 15. The fourth split-part conductor 16*d* is arranged so as to connect the second split-part conductor 16*b* to the other side (the lower side of the sheet) facing the one side of the opening 15. Note that, the first split-part conductor 16*a* and the second split-part conductor 16*b* arranged so as to face each other form a split part.

In addition, the feed conductor 12 formed in the opening region of the opening 15 is arranged from the one side the opening 15 to the other side facing to the one side so as to be parallel to the third split-part conductor 16*c* and the fourth split-part conductor 16*d*. Here, the power feed part 13 is arranged on the other side (the lower side of the sheet) of the opening 15. Thus, the parallel split-ring resonator 14 is supplied with AC power from the power feed part 13 through the feed conductor 12.

FIG. 14 is a schematic diagram showing a current flow at the operation frequency of the SRR antenna of the antenna device A10. In FIG. 14, a thick broken line with an arrow represents a current flow.

As shown in FIG. 14, the parallel split-ring resonator 14 constituting the SRR antenna is supplied with AC power from the power feed part 13, and a first current I1 and a second current I2 flow therethrough. Specifically, the first current I1 flows through a loop-like first path formed by the feed conductor 12, the third split-part conductor 16*c*, the first split-part conductor 16*a*, the second split-part conductor 16*b*, the fourth split-part conductor 16*d*, and a part of the outer peripheral sides of the opening 15. Here, the part of the outer peripheral side of the opening 15 is, of the outer peripheral sides of the opening 15, a part the outer peripheral sides positioned on the same opening region side as the feed conductor 12. The second current I2 flows through a loop-like second path constituted by the third split-part conductor 16*c*, the first split-part conductor 16*a*, the second split-part conductor 16*b*, the fourth split-part conductor 16*d*, and a part of the outer peripheral sides of the opening 15. Here, the part of the outer peripheral sides of the opening 15 is, of the outer peripheral sides of the opening 15, a part of the outer peripheral sides positioned on the opposite side across the split part 16 from the feed conductor 12. The parallel split-ring resonator 14 emits electromagnetic waves using the first current I1 flowing through the first path and the second current I2 flowing through the second path as a wave source.

FIG. 15 is a circuit diagram showing an equivalent circuit of the parallel split-ring resonator 14.

As shown in FIG. 15, the equivalent circuit of the parallel split-ring resonator 14 includes a first coil part L1, a second coil part L2, and a capacitor part C. Note that, the first coil part L1 equivalently represents the first path through which the first current I1 flows. The second coil part L2 equivalently represents the second path through which the second current I2 flows. The capacitor part C equivalently represents the split formed by the first split-part conductor 16*a* and the second split-part conductor 16*b*. The equivalent circuit of the parallel split-ring resonator 14 constitutes a resonator formed by two serial resonance circuits parallelly connected by the first coil part L1, the second coil part L2, and the capacitor part C. The resonance frequency of this resonator determines the operation frequency of the SRR antenna of the antenna device A10. That is, the SRR antenna of the antenna device A10 emits electromagnetic waves having the same frequency as the resonance frequency of this resonator.

FIG. 16 is a Smith chart showing an example of an impedance characteristic of the SRR antenna of the antenna device A10. FIG. 17 is a graph showing an example of a return loss characteristic of the SRR antenna of the antenna device A10. Note that, FIGS. 16 and 17 show the same measurement result with different charts.

In the Smith chart shown in FIG. 16, the locus of the impedance to the frequency is represented by a thick line. In the locus of the impedance represented by the thick line, the point closest to the center of the Smith chart or the point crossing the horizontal line through the center indicates the resonance frequency of the parallel split-ring resonator 14, that is, the impedance at the operation frequency of the SRR antenna. FIG. 16 shows that the antenna device A10 (SRR antenna) has a characteristic that the impedance at the resonance frequency is fairly close to the antenna reference resistance value 50Ω.

In the return-loss characteristic diagram shown in FIG. 17, as the impedance at the resonance frequency becomes closer to the antenna reference resistance value 50Ω, the return loss value at the resonance frequency becomes smaller. That is, as the locus of the impedance at the resonance frequency becomes closer to the center in the Smith chart of FIG. 16, the return loss value becomes smaller in the return-loss characteristic diagram of FIG. 17, and as the return loss value becomes smaller, the antenna characteristic becomes more excellent.

Note that, in the return-loss characteristic diagram of FIG. 17, the frequency at which the return loss value is the smallest is referred to as an antenna resonance frequency, and indicates the frequency (operation frequency) at which the antenna properly operates. Generally, in order to properly operate as an antenna, it is desired that the return loss value at a frequency for an antenna to operate is −5 dB or less. As shown by the arrow in the return-loss characteristic diagram of FIG. 17, the return loss value at the resonance frequency (that is, the antenna operation frequency) is much smaller than −5 dB, and the antenna device A10 (SRR antenna) properly operates.

As described above, radio apparatuses have been required to perform radio communication in accordance with a plurality of different communication standards. Accordingly, antennas to be mounted on radio apparatuses are required to transmit and receive radio signals in a plurality of frequency bands (communication bands). In other words, antennas to be mounted on radio apparatuses are required to operate at a plurality of frequencies.

However, the antenna device disclosed in Japanese Unexamined Patent Application Publication No. 2018-129595 is intended to perform radio communication at a single frequency band, and cannot perform radio communication at a plurality of frequency bands.

SUMMARY

The present disclosure is to provide an antenna device and a radio apparatus that solve the above problem.

According to an example embodiment, an antenna device includes:

a first parallel split-ring resonator; and a second parallel split-ring resonator, in which the first parallel split-ring resonator includes:

a first opening formed inside an earth plate;

a first feed conductor formed, in an opening region of the first opening, from a first outer peripheral side, the first outer peripheral side being one of outer peripheral sides of the first opening, to a second outer peripheral side facing the first outer peripheral side, and supplied with AC power from the first outer peripheral side; and a first split part formed in the opening region of the first opening, the second parallel split-ring resonator includes:

a second opening formed inside the earth plate;

a second feed conductor formed, in an opening region of the second opening, from a third outer peripheral side, the third outer peripheral side being one of outer peripheral sides of the second opening, to a fourth outer peripheral side facing the third outer peripheral side, and supplied with the AC power from the third outer peripheral side; and a second split part formed in the opening region of the second opening, the first split part includes:

a first split-part conductor arranged so as to face a part of a first current path formed by a part of the outer peripheral sides of the first opening and the first feed conductor; and a second split-part conductor connecting the first split-part conductor to another part of the first current path, and the second split part includes:

a third split-part conductor arranged so as to face a part of a second current path formed by a part of the outer peripheral sides of the second opening and the second feed conductor; and a fourth split-part conductor connecting the third split-part conductor and another part of the second current path.

BRIEF DESCRIPTION OF DRAWINGS

The above and other aspects, features and advantages of the present disclosure will become more apparent from the following description of certain example embodiments when taken in conjunction with the accompanying drawings, in which.

EMBODIMENTS

Hereinafter, example embodiments are described with reference to the drawings. Note that, the drawings are simplified, and the technical scope of the example embodiments should not be narrowly interpreted based on the drawings. The same components are denoted by the same reference signs, and repeated explanations thereof are omitted.

The present disclosure will be described below in separate sections or example embodiments as needed. However, they are not unrelated to each other unless otherwise explicitly specified, and one of them is a modification, an application, detailed explanation, or supplementary explanation of a part or all of the other. Furthermore, when the number or the like (including the number of pieces, a numerical value, an amount, and a range) of components is referred to in the following example embodiments, the number or the like is not limited to a specific number but may be more than or less than the specific number unless otherwise explicitly specified or unless obviously limited to the specific number in principle.

Furthermore, the components (including operation steps) in the following example embodiments are not necessarily essential unless otherwise explicitly specified or unless obviously necessary in principle. Similarly, when a shape, a positional relation, or the like of the components is referred to in the following example embodiments, what is approximate to or similar to the shape is substantially included unless otherwise explicitly specified or unless obviously not applicable in principle. This similarly applies to the above number or the like (including the number of pieces, a numerical value, an amount, and a range).

First Example Embodiment

Figure 1:
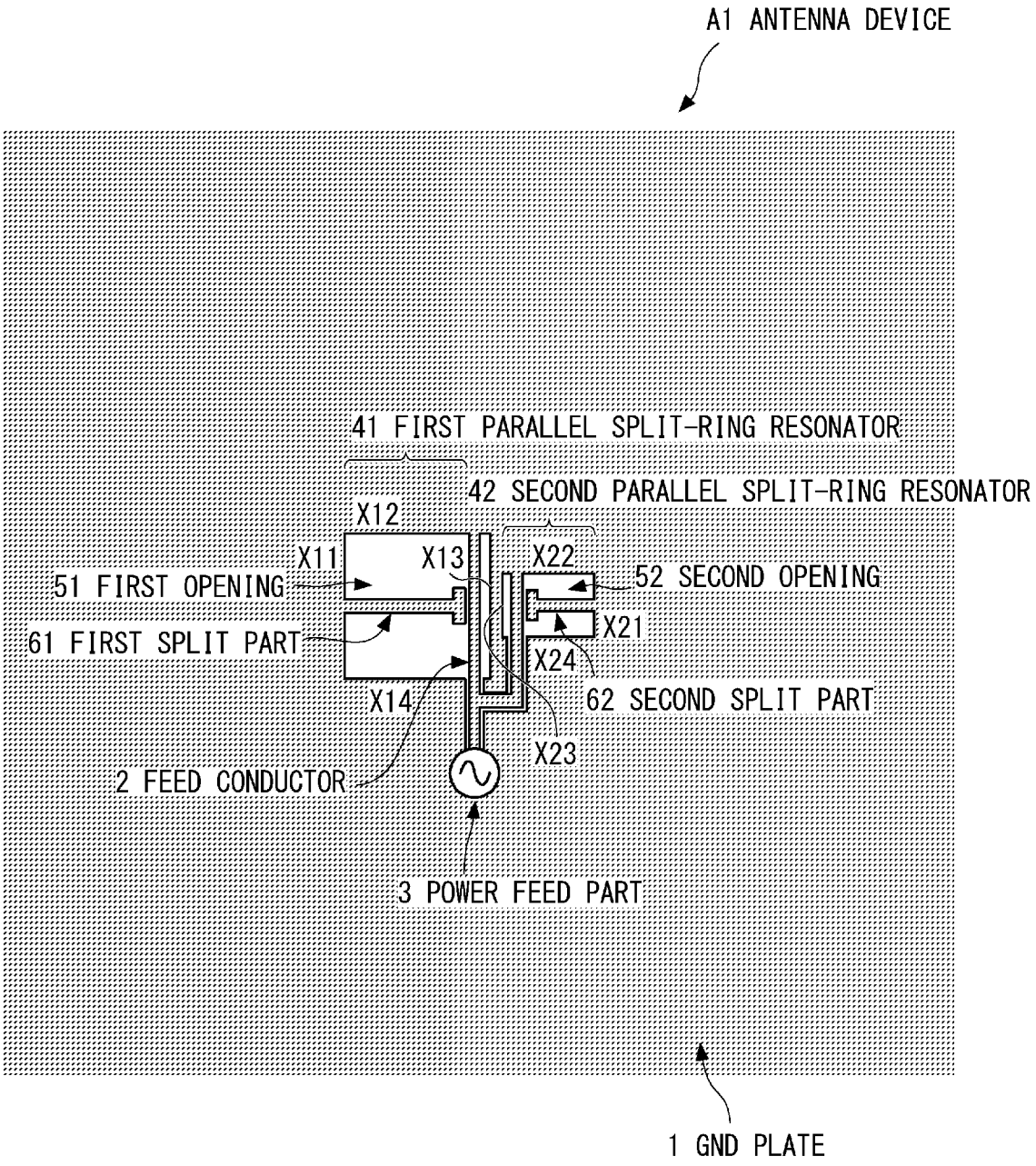
FIG. 1 is a conceptual diagram showing a configuration example of an antenna device according to a first example embodiment.

FIG. 1 is a conceptual diagram showing a configuration example of an antenna device A1 according to a first example embodiment.

As shown in FIG. 1, in the antenna device A1, a rectangular first opening 51 and a rectangular second opening 52 are formed inside a GND plate 1 so as not to be in contact with any of the outer peripheral sides of the GND plate 1. In addition, a first parallel split-ring resonator 41 is formed in an opening region of the first opening 51, and a second parallel split-ring resonator 42 is formed in an opening region of the second opening 52. The first parallel split-ring resonator 41 and the second parallel split-ring resonator 42 constitute a split-ring resonator antenna (SRR antenna).

In the following description, of the outer peripheral sides of the first opening 51, one side positioned closest to the second opening 52 is denoted by X13, another side facing the outer peripheral side X13 (the side farthest from the second opening 52) is denoted by X11. In addition, of the other two sides orthogonal to the outer peripheral sides X11 and X13, one side on which a power feed part 3 is arranged is denoted by X14, and the other side facing the outer peripheral side X14 is denoted by X12.

Similarly, of the outer peripheral sides of the second opening 52, one side positioned closest to the first opening 51 is denoted by X23, and another side facing the outer peripheral side X23 (the side farthest from the first opening 51) is denoted by X21. In addition, of the other two sides orthogonal to the outer peripheral sides X21 and X23, one side on which the power feed part 3 is arranged is denoted by X24, and the other side facing the outer peripheral side X24 is denoted by X22.

In the first parallel split-ring resonator 41, a first split part 61 is arranged in the opening region of the first opening 51 so as to project from the outer peripheral side X11 of the first opening 51 toward the facing outer peripheral side X13. In addition, in the opening region of the first opening 51, a first feed conductor 21 is arranged in the opening region between the first split part 61 and the outer peripheral side X13 of the first opening 51. The first feed conductor 21 is formed by a part branched from a feed conductor 2. Specifically, in the opening region, the first feed conductor 21 is arranged from the outer peripheral side X12 orthogonal to the two sides X11 and X13 of the first opening 51 to the facing outer peripheral side X14.

In the second parallel split-ring resonator 42, a second split part 62 is arranged in the opening region of the second opening 52 so as to project from the outer peripheral side X21 of the second opening 52 toward the facing outer peripheral side X23. In addition, in the opening region of the second opening 52, a second feed conductor 22 is arranged in the opening region between the second split part 62 and the outer peripheral side X23 of the second opening 52. The second feed conductor 22 is formed by another part branched from the feed conductor 2. Specifically, in the opening region, the second feed conductor 22 is arranged from the outer peripheral side X22 orthogonal to the two sides X21 and X23 of the second opening 52 to the facing outer peripheral side X24.

The first feed conductor 21 and the second feed conductor 22 are merged on the side of the outer peripheral side X14 of the first opening 51 and the outer peripheral side X24 of the second opening 52, and the power feed part 3 is arranged ahead of the merging point. Thus, the first parallel split-ring resonator 41 and the second parallel split-ring resonator 42 are supplied with AC power from the power feed part 3 through the feed conductor 2.

Figure 2:
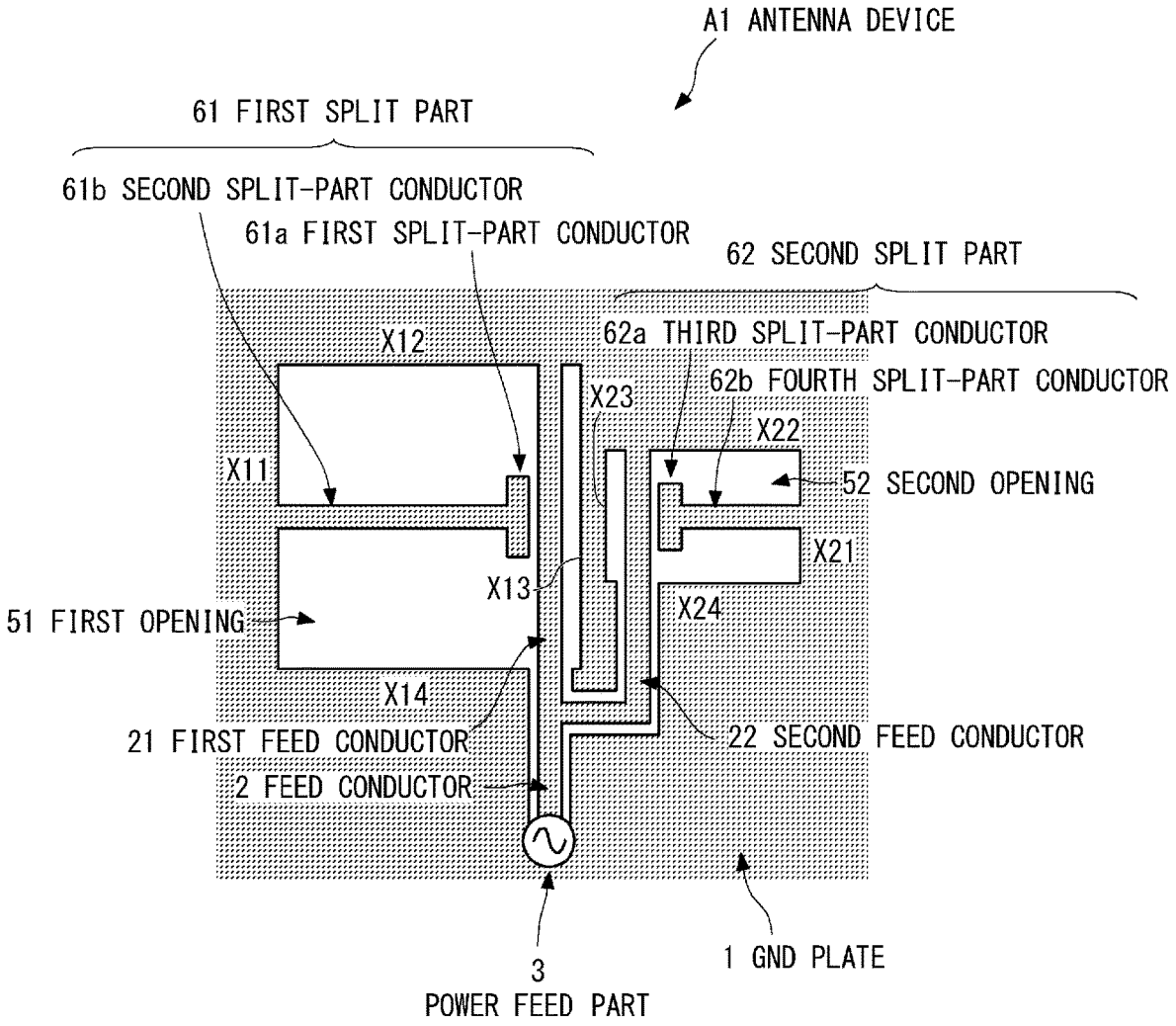
FIG. 2 is an enlarged view of two parallel split-ring resonators provided to the antenna device shown in FIG. 1.

FIG. 2 is an enlarged view of the first parallel split-ring resonator 41 and the second parallel split-ring resonator 42 provided to the antenna device A1.

As shown in FIG. 2, the first split part 61 formed in the opening region of the first opening 51 is constituted by a first split-part conductor 61*a* and a second split-part conductor 61*b*. The first split-part conductor 61*a* is arranged near the center of the opening region of the first opening 51. The second split-part conductor 61*b* is arranged so as to connect the first split-part conductor 61*a* to the outer peripheral side X11 of the first opening 51.

In addition, the first feed conductor 21 formed in the opening region of the first opening 51 is arranged, in the opening region between the first split part 61 and the outer peripheral side X13 of the first opening 51, from the outer peripheral side X12 of the first opening 51 to the facing outer peripheral side X14. Note that, the first split-part conductor 61*a* and the first feed conductor 21 are arranged so as to face each other, and form a split (or a slit).

Similarly, the second split part 62 formed in the opening region of the second opening 52 is constituted by a third split-part conductor 62*a* and a fourth split-part conductor 62*b*. The third split-part conductor 62*a* is arranged near the center of the opening region of the second opening 52. The fourth split-part conductor 62*b* is arranged so as to connect the third split-part conductor 62*a* to the outer peripheral side X21 of the second opening 52.

In addition, the second feed conductor 22 formed in the opening region of the second opening 52 is arranged, in the opening region between the second split part 62 and the outer peripheral side X23 of the second opening 52, from the outer peripheral side X22 of the second opening 52 to the facing outer peripheral side X24. Note that, the third split-part conductor 62*a* and the second feed conductor 22 are arranged so as to be face each other, and form a split.

Here, the first feed conductor 21 and the second feed conductor 22 are merged on the side of the outer peripheral side X14 of the first opening 51 and the outer peripheral side X24 of the second opening 52, and the power feed part 3 is arranged ahead of the merging point. Thus, the first parallel split-ring resonator 41 and the second parallel split-ring resonator 42 are supplied with AC power from the power feed part 3 through the feed conductor 2.

Figure 3:
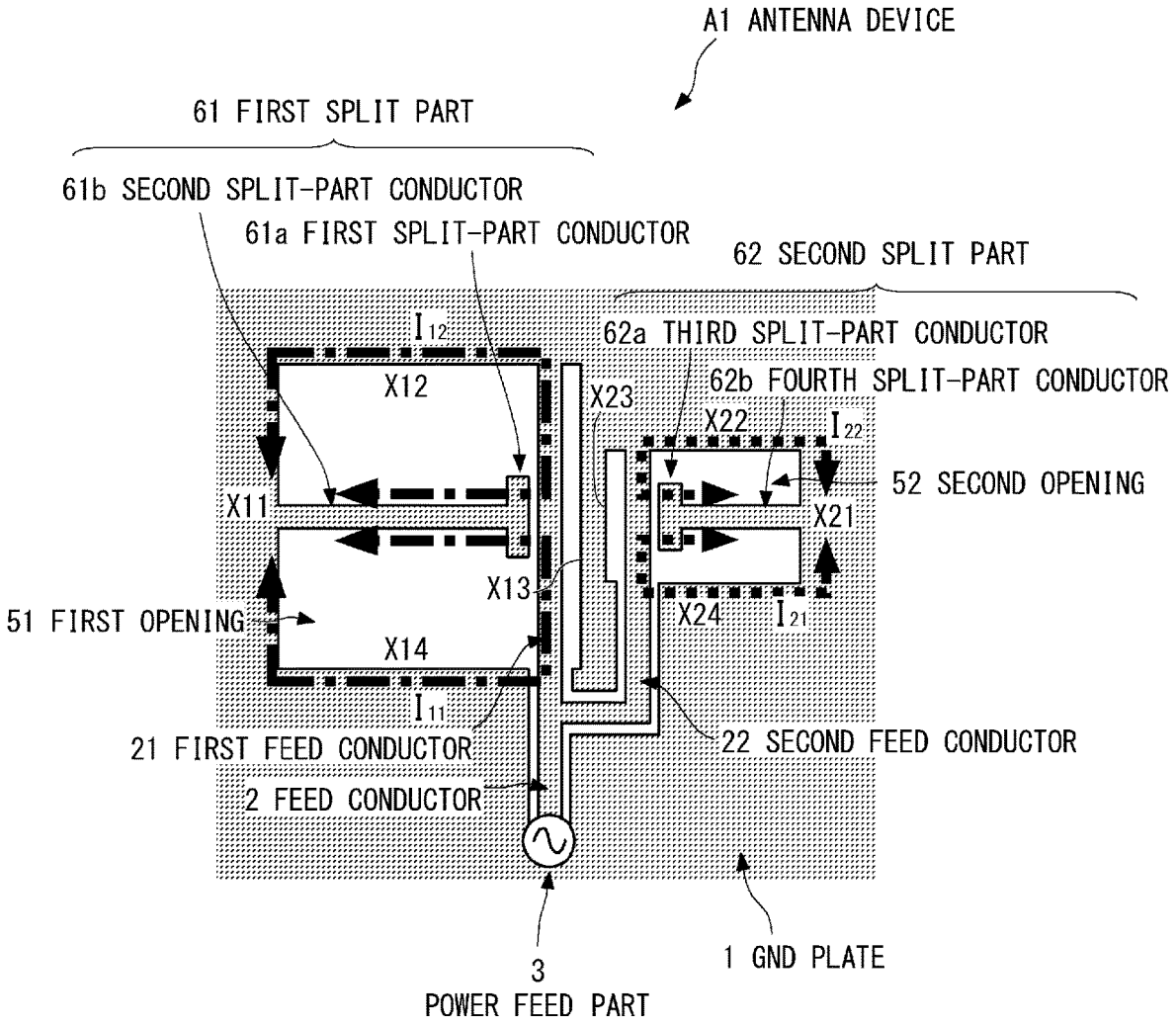
FIG. 3 is a schematic diagram showing a current flow at an operation frequency of an SRR antenna of the antenna device shown in FIG. 1.

FIG. 3 is a schematic diagram showing a current flow at the operation frequency of the SRR antenna of the antenna device A1. In FIG. 3, a thick dash-dot line with an arrow represents a current flow at a first operation frequency, and a thick dot line with an arrow represents a current flow at a second operation frequency.

As shown in FIG. 3, the first parallel split-ring resonator 41 constituting a part of the SRR antenna is supplied with AC current from the power feed part 3, and currents I11 and I12 flow therethrough. The current I11 flows through a loop-like path formed by a part of the first feed conductor 21, the outer peripheral side X14 of the first opening 51, and a part of the outer peripheral side X11. The current I12 flows through a loop-like path formed by another part of the first feed conductor 21, the outer peripheral side X12 of the first opening 51, and another part of the outer peripheral side X11. The first parallel split-ring resonator 41 emits electromagnetic waves having the first operation frequency using the current I11 and I12 as a wave source.

Similarly, the second parallel split-ring resonator 42 constituting another part of the SRR antenna is supplied with AC current from the power feed part 3, and currents I21 and I22 flow therethrough. The current I21 flows through a loop-like path formed by a part of the second feed conductor 22, the outer peripheral side X24 of the second opening 52, and a part of the outer peripheral side X21. The current I22 flows through a loop-like path formed by another part of the second feed conductor 22, the outer peripheral side X22 of the second opening 52, and another part of the outer peripheral side X21. The second parallel split-ring resonator 42 emits electromagnetic waves having the second operation frequency using the current I21 and I22 as a wave source.

Figure 4:
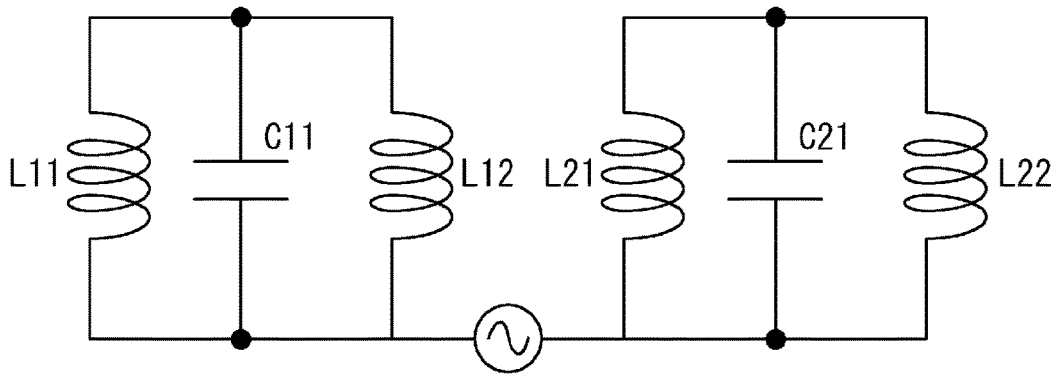
FIG. 4 is a circuit diagram showing an equivalent circuit of the two parallel split-ring resonators provided to the antenna device shown in FIG. 1.

FIG. 4 is a circuit diagram showing an equivalent circuit of the first parallel split-ring resonator 41 and the second parallel split-ring resonator 42. The equivalent circuit shown in FIG. 4 includes coil parts L11, L12, L21, and L22, and capacitor parts C11 and C21.

Note that, the coil part L11 equivalently represents the path through which the current I11 flows. The coil part L12 equivalently represents the path through which the current I12 flows. The capacitor part C11 equivalently represents the split formed by the first split-part conductor 61*a* and the first feed conductor 21. In addition, the coil part L21 equivalently represents the path through which the current I21 flows. The coil part L22 equivalently represents the path through which the current I22 flows. The capacitor part C21 equivalently represents the split formed by the third split-part conductor 62*a* and the second feed conductor 22.

Here, a first resonator is constituted by two serial resonance circuits parallelly connected by the coil parts L11 and L12 and the capacitor part C11. The resonance frequency of this first resonator determines the first operation frequency of the SRR antenna of the antenna device A1. In addition, a second resonator is constituted by two serial resonance circuits parallelly connected by the coil parts L21 and L22 and the capacitor part C21. The resonance frequency of this second resonator determines the second operation frequency of the SRR antenna of the antenna device A1. That is, the SRR antenna of the antenna device A1 is capable of emitting electromagnetic waves having the first and second operation frequencies same as the respective resonance frequencies of the first resonator and second resonator.

Note that, by changing the size of the first opening 51 to change the lengths of the paths through which the currents I11 and I12 flow, the inductance of one or both of the equivalently-represented coil parts L11 and L12 can be changed. Thus, it is possible to adjust the resonance frequency of the first resonator (that is, the first operation frequency of the SRR antenna) to a desired frequency. Similarly, by changing the size of the second opening 52 to change the lengths of the paths through which the currents I21 and I22 flow, the inductance of one or both of the equivalently-represented coil parts L21 and L22 can be changed. Thus, it is possible to adjust the resonance frequency of the second resonator (that is, the second operation frequency of the SRR antenna) to a desired frequency.

In addition, by changing the width of the side facing the first split-part conductor 61*a* (the length of the side parallel to the first feed conductor 21), the capacitance value of the capacitor part C11 equivalently representing the split constituted by the first split-part conductor 61*a* and the first feed conductor 21 can be changed. Thus, it is possible to adjust the resonance frequency of the first resonator (that is, the first operation frequency of the SRR antenna) to a desired frequency. Similarly, by changing the width of the side facing the third split-part conductor 62*a* (the length of the side parallel to the second feed conductor 22), the capacitance value of the capacitor part C21 equivalently representing the split constituted by the third split-part conductor 62*a* and the second feed conductor 22 can be changed. Thus, it is possible to adjust the resonance frequency of the second resonator (that is, the second operation frequency of the SRR antenna) to a desired frequency.

In addition, by changing the distance between the first split-part conductor 61*a* and the first feed conductor 21, the capacitance value of the capacitor part C11 equivalently representing the split constituted by the first split-part conductor 61*a* and the first feed conductor 21 can be changed. Thus, it is possible to adjust the resonance frequency of the first resonator (that is, the first operation frequency of the SRR antenna) to a desired frequency. Similarly, by changing the distance between the third split-part conductor 62*a* and the second feed conductor 22, the capacitance value of the capacitor part C21 equivalently representing the split constituted by the third split-part conductor 62*a* and the second feed conductor 22 can be changed. Thus, it is possible to adjust the resonance frequency of the second resonator (that is, the second operation frequency of the SRR antenna) to a desired frequency.

In addition, a loop-like path formed by the first feed conductor 21, a part of the outer peripheral side X12 of the first opening 51, the outer peripheral side X13, and a part of the outer peripheral side X14 (that is, the path through which both currents I11 and I12 do not flow) equivalently short-circuits the feed conductor 2. This path serves as an impedance matching element that brings the locus of the impedance at the first operation frequency of the SRR antenna close to the reference resistance value 50Ω. Similarly, a loop-like path formed by the second feed conductor 22, a part of the outer peripheral side X22 of the second opening 52, the outer peripheral side X23, and a part of the outer peripheral side X24 (that is, the path through which both currents I21 and I22 do not flow) equivalently short-circuits the feed conductor 2. This path serves as an impedance matching element that brings the locus of the impedance at the second operation frequency of the SRR antenna close to the reference resistance value 50Ω.

Figure 5:
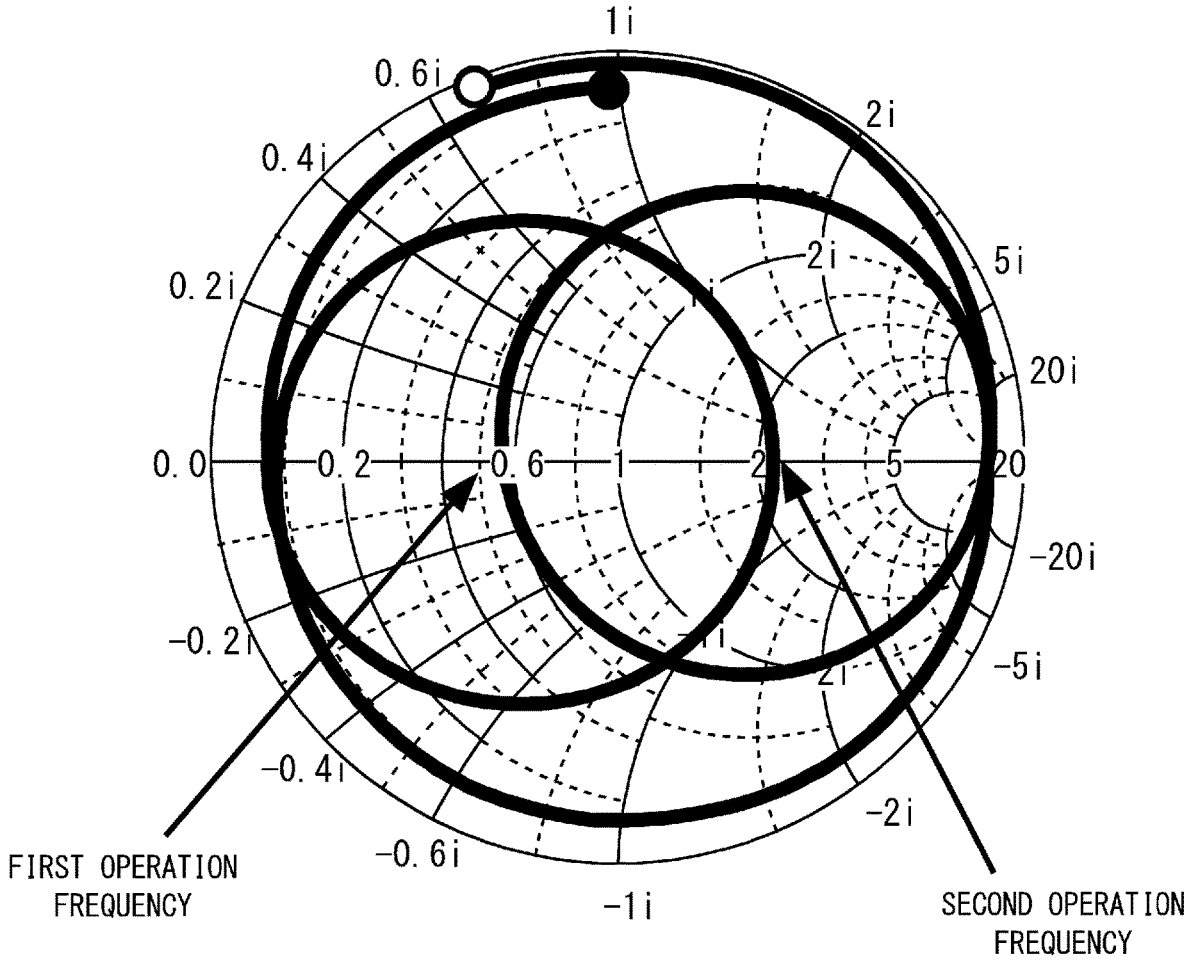
FIG. 5 is a Smith chart showing an example of an impedance characteristic of the SRR antenna of the antenna device shown in FIG. 1.
Figure 6:
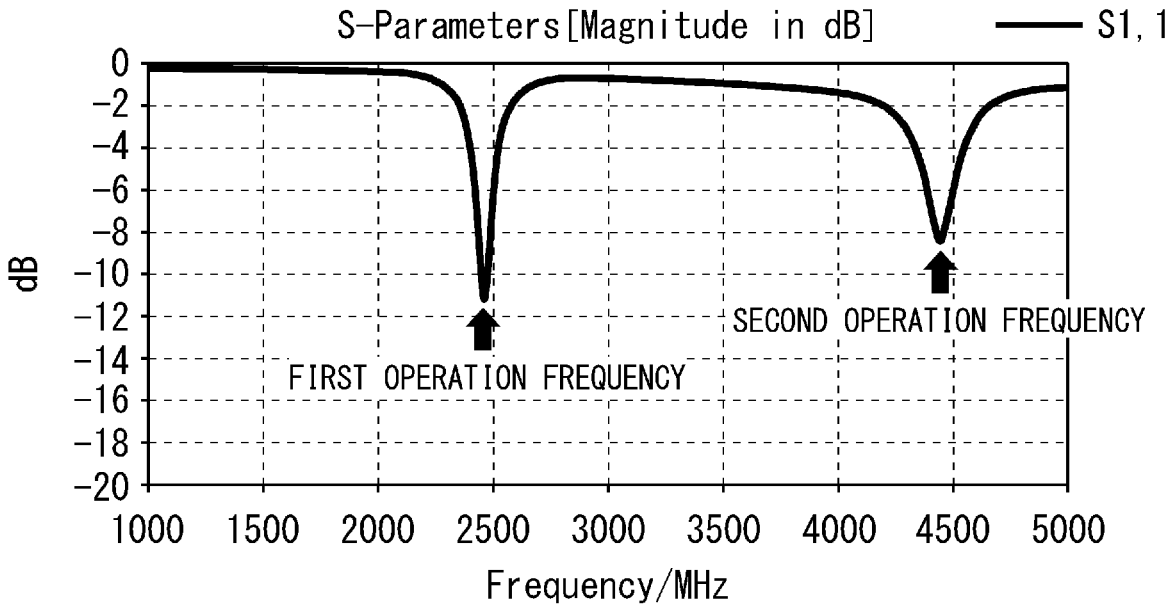
FIG. 6 is a characteristic diagram showing an example of a return loss characteristic of the SRR antenna of the antenna device shown in FIG. 1.

FIG. 5 is a Smith chart showing an example of an impedance characteristic of the SRR antenna of the antenna device A1. FIG. 6 is a graph showing an example of a return loss characteristic of the SRR antenna of the antenna device A1. Note that, FIGS. 5 and 6 show the same measurement result with different charts.

In the Smith chart shown in FIG. 5, the locus of the impedance to the frequency is represented by a thick line. In the locus represented by the thick line, the two points closest to the center of the Smith chart or the two points crossing the horizontal line though the center indicate the respective resonance frequencies of the parallel split-ring resonators 41 and 42, that is, the impedance at the first and second operation frequencies of the SRR antenna. FIG. 5 shows that the antenna device A1 (SRR antenna) has a characteristic that the impedance at the resonance frequency is fairly close to the antenna reference resistance value 50Ω.

In the return-loss characteristic diagram shown in FIG. 6, as the impedance at the resonance frequency becomes closer to the antenna reference resistance value 50Ω, the return loss value at the resonance frequency becomes smaller. That is, as the locus of the impedance at the resonance frequency becomes closer to the center in the Smith chart of FIG. 5, in the return-loss characteristic diagram of FIG. 6, and as the return loss value becomes smaller, the antenna characteristic becomes more excellent.

Note that, in the return-loss characteristic diagram of FIG. 6, the frequencies at which the return loss values are smaller are referred to as antenna resonance frequencies, and indicate the frequencies (first and second operation frequencies) at which the antenna properly operates. Generally, in order to properly operate as an antenna, it is desired that the return loss value at a frequency for an antenna to operate is −5 dB or less. As shown by the arrows in the return-loss characteristic diagram of FIG. 6, the return loss values at the resonance frequencies (that is, the first and second operation frequencies) are much smaller than −5 dB, and the antenna device A1 (SRR antenna) properly operates.

As described above, in the antenna device A1 according to the first example embodiment, the SRR antenna is configured by forming a plurality of parallel split-ring resonators inside the GND plate 1. Thus, it is possible for the antenna device A1 to arrange the SRR antenna at any available region of the GND plate 1 similarly to the antenna device A10, and to be downsized. Furthermore, it is possible for the antenna device A1 to transmit and receive radio signals in a plurality of frequency bands (communication bands) unlike the antenna device A10. In other words, it is possible for the antenna device A1 to operate at a plurality of frequencies. Note that, the operation frequencies are adjustable individually. As the result, it is possible for, for example, a radio apparatus mounting the antenna device A1 to be downsized, and to perform radio communication in accordance with a plurality of communication standard.

Second Example Embodiment

Next, an antenna device A2 according to a second example embodiment is described. In the antenna device A2, the configurations of a first split part provided to a first parallel split-ring resonator 41 and a second split part provided to a second parallel split-ring resonator 42 are different from those in the antenna device A1.

Specifically, in the antenna device A2, a first split part 71 and a second split part 72 are provided instead of the first split part 61 and the second split part 62 in the antenna device A1, respectively.

Figure 7:
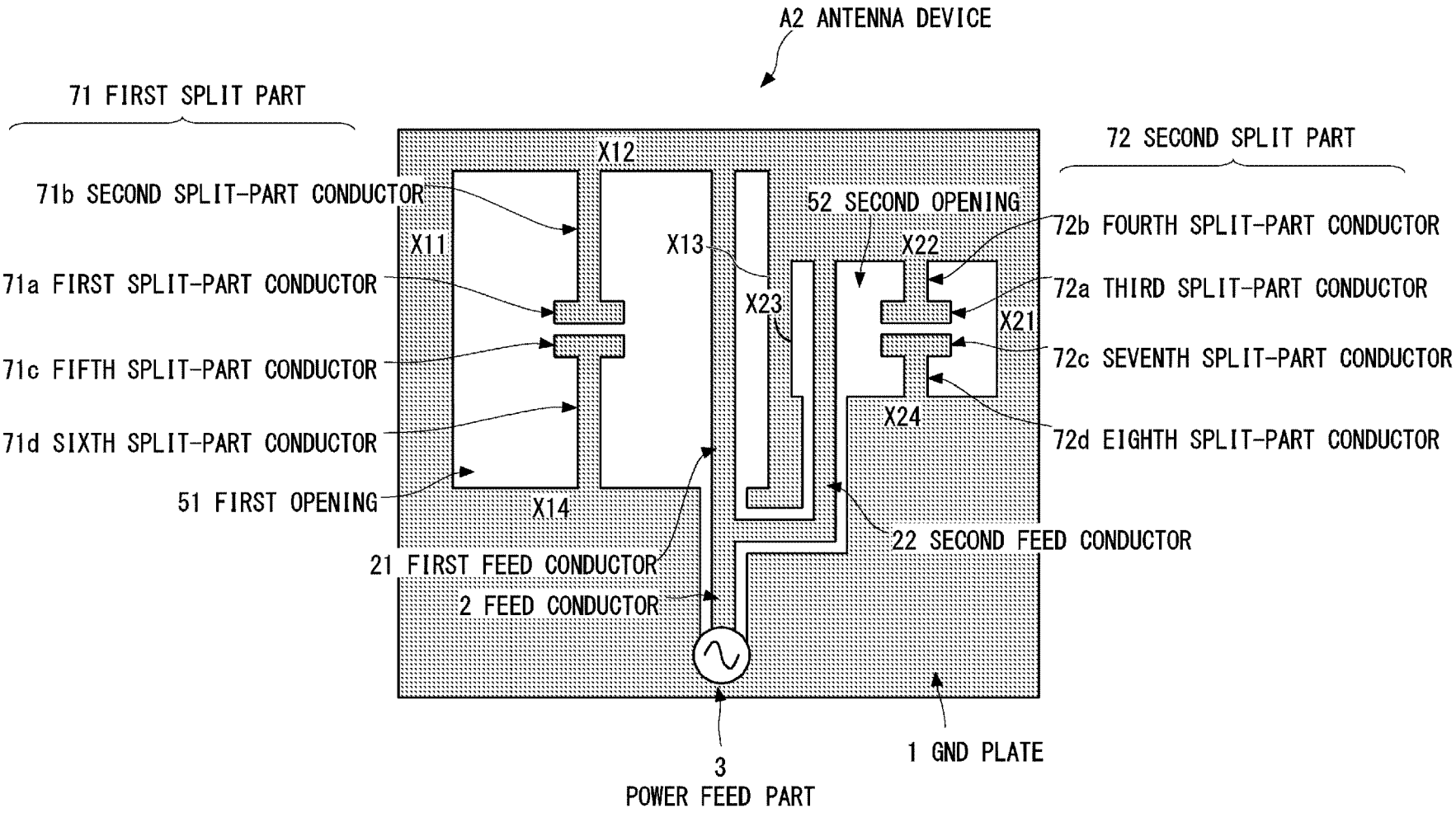
FIG. 7 is an enlarged view of two parallel split-ring resonators provided to an antenna device according to a second example embodiment.

FIG. 7 is an enlarged view of the first parallel split-ring resonator 41 and the second parallel split-ring resonator 42 provided to the antenna device A2.

As shown in FIG. 7, the first split part 71 is formed, in an opening region of a first opening 51, from an outer peripheral side X12 of the first opening 51 to the facing outer peripheral side X14 so as to be parallel to a first feed conductor 21. Specifically, the first split part 71 formed in the opening region of the first opening 51 is constituted by a first split-part conductor 71*a*, a second split-part conductor 71*b*, a fifth split-part conductor 71*c*, and a sixth split-part conductor 71*d*. The first split-part conductor 71*a* and the fifth split-part conductor 71*c* are arranged in the first opening 51 so as to face each other. The second split-part conductor 71*b* is arranged so as to connect the first split-part conductor 71*a* to the outer peripheral side X12 of the first opening 51. The sixth split-part conductor 71*d* is arranged so as to connect the fifth split-part conductor 71*c* to the outer peripheral side X14 of the first opening 51. Note that, the first split-part conductor 71*a* and the fifth split-part conductor 71*c* arranged so as to face each other form a split.

Similarly, the second split part 72 is formed, in an opening region of a second opening 52, from an outer peripheral side X22 of the second opening 52 to the facing outer peripheral side X24 so as to be parallel to a second feed conductor 22. Specifically, the second split part 72 formed in the opening region of the second opening 52 is constituted by a third split-part conductor 72*a*, a fourth split-part conductor 72*b*, a seventh split-part conductor 72*c*, and an eighth split-part conductor 72*d*. The third split-part conductor 72*a* and the seventh split-part conductor 72*c* are arranged in the second opening 52 so as to face each other. The fourth split-part conductor 72*b* is arranged so as to connect the third split-part conductor 72*a* to the outer peripheral side X22 of the second opening 52. The eighth split-part conductor 72*d* is arranged so as to connect the seventh split-part conductor 72*c* to the outer peripheral side X24 of the second opening 52. Note that, the third split-part conductor 72*a* and the seventh split-part conductor 72*c* arranged so as to face each other form a split.

The other configurations of the antenna device A2 are similar to those in the antenna device A1, and the descriptions thereof are omitted.

Figure 8:
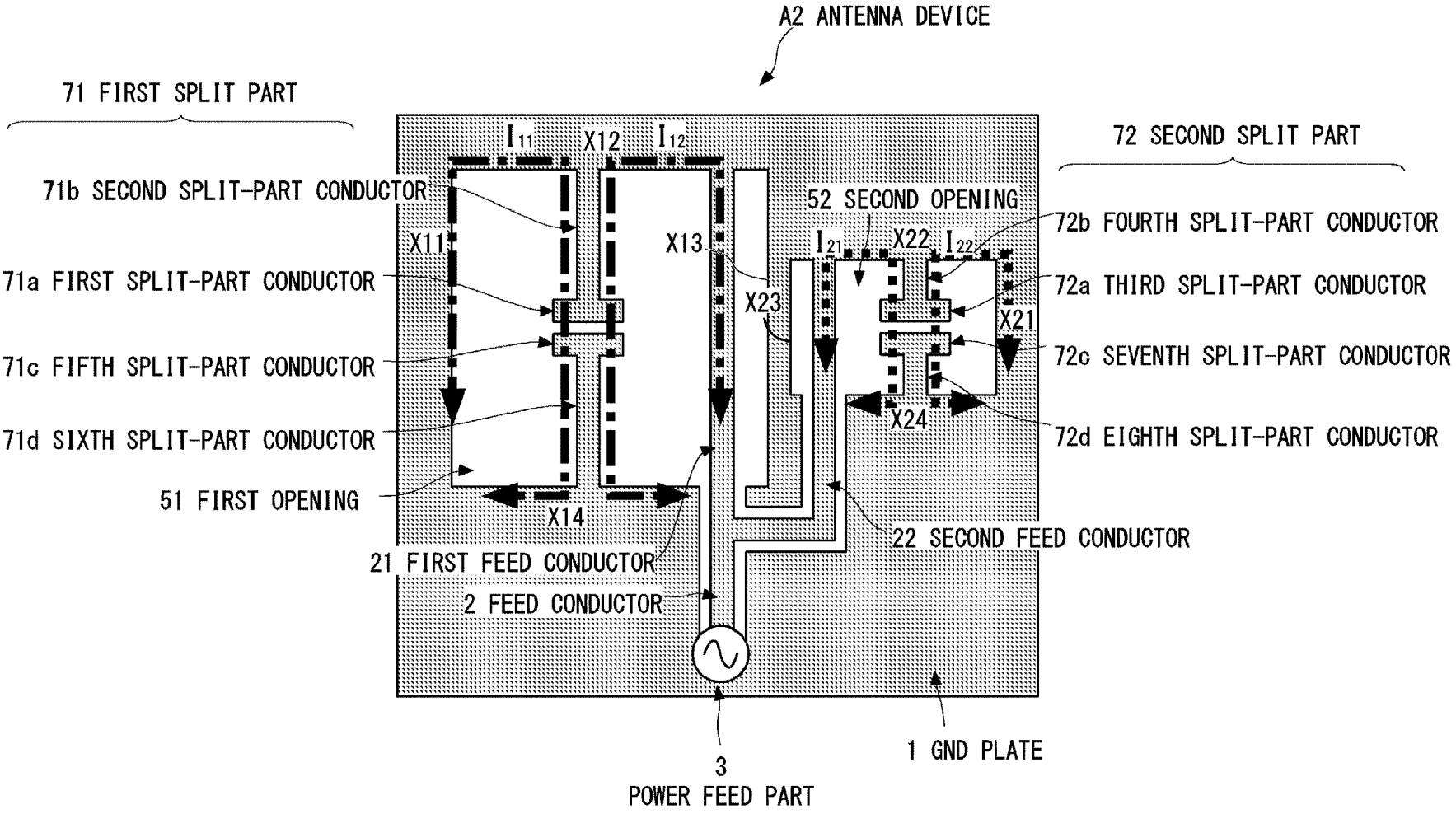
FIG. 8 is a schematic diagram showing a current flow at an operation frequency of an SRR antenna of the antenna device shown in FIG. 7.

FIG. 8 is a schematic diagram showing a current flow at the operation frequency of an SRR antenna of the antenna device A2. In FIG. 8, a thick dash-dot line with an arrow represents a current flow at a first operation frequency, and a thick dot line with an arrow represents a current flow at a second operation frequency.

As shown in FIG. 8, the first parallel split-ring resonator 41 constituting a part of the SRR antenna is supplied with AC current from a power feed part 3, and currents I11 and I12 flow therethrough. The current I11 flows through a loop-like path formed by the first split-part conductor 71*a*, the second split-part conductor 71*b*, a part of the outer peripheral side X12 of the first opening 51, an outer peripheral side X11, a part of the outer peripheral side X14, the sixth split-part conductor 71*d*, and the fifth split-part conductor 71*c*. The current I12 flows through a loop-like path formed by the first split-part conductor 71*a*, the second split-part conductor 71*b*, another part of the outer peripheral side X12 of the first opening 51, the first feed conductor 21, another part of the outer peripheral side X14, the sixth split-part conductor 71*d*, and the fifth split-part conductor 71*c*. The first parallel split-ring resonator 41 emits electromagnetic waves having the first operation frequency using the currents I11 and I12 as a wave source.

Similarly, the second parallel split-ring resonator 42 constituting another part of the SRR antenna is supplied with AC current from the power feed part 3, and currents I21 and I22 flow therethrough. The current I21 flows through a loop-like path formed by the third split-part conductor 72*a*, the fourth split-part conductor 72*b*, a part of the outer peripheral side X22 of the second opening 52, an outer peripheral side X21, a part of the outer peripheral side X24, the eighth split-part conductor 72*d*, and the seventh split-part conductor 72*c*. The current I22 flows through a loop-like path formed by the third split-part conductor 72*a*, the fourth split-part conductor 72*b*, another part of the outer peripheral side X22 of the second opening 52, the second feed conductor 22, another part of the outer peripheral side X24, the eighth split-part conductor 72*d*, and the seventh split-part conductor 72*c*. The second parallel split-ring resonator 42 emits electromagnetic waves having the second operation frequency using the currents I21 and I22 as a wave source.

Figure 9:
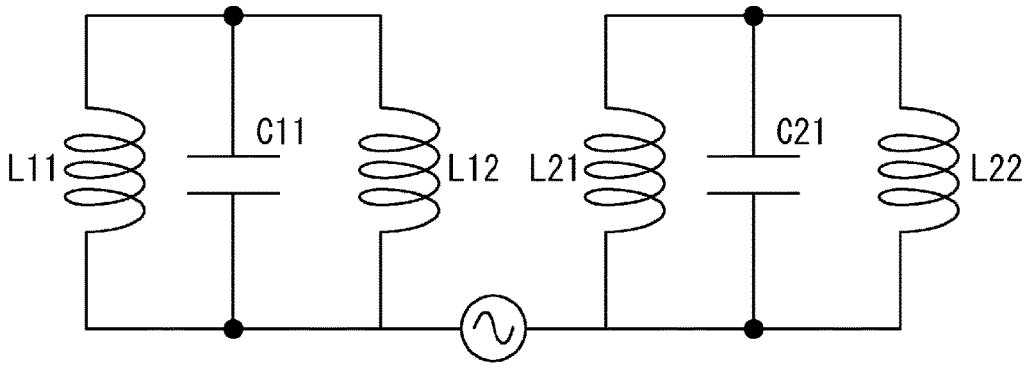
FIG. 9 is a circuit diagram showing an equivalent circuit of the two parallel split-ring resonators provided to the antenna device shown in FIG. 7.

FIG. 9 is a circuit diagram showing an equivalent circuit of the first parallel split-ring resonator 41 and the second parallel split-ring resonator 42 provided to the antenna device A2. The equivalent circuit shown in FIG. 9 has the same circuit configuration as the equivalent circuit shown in FIG. 4.

Figure 10:
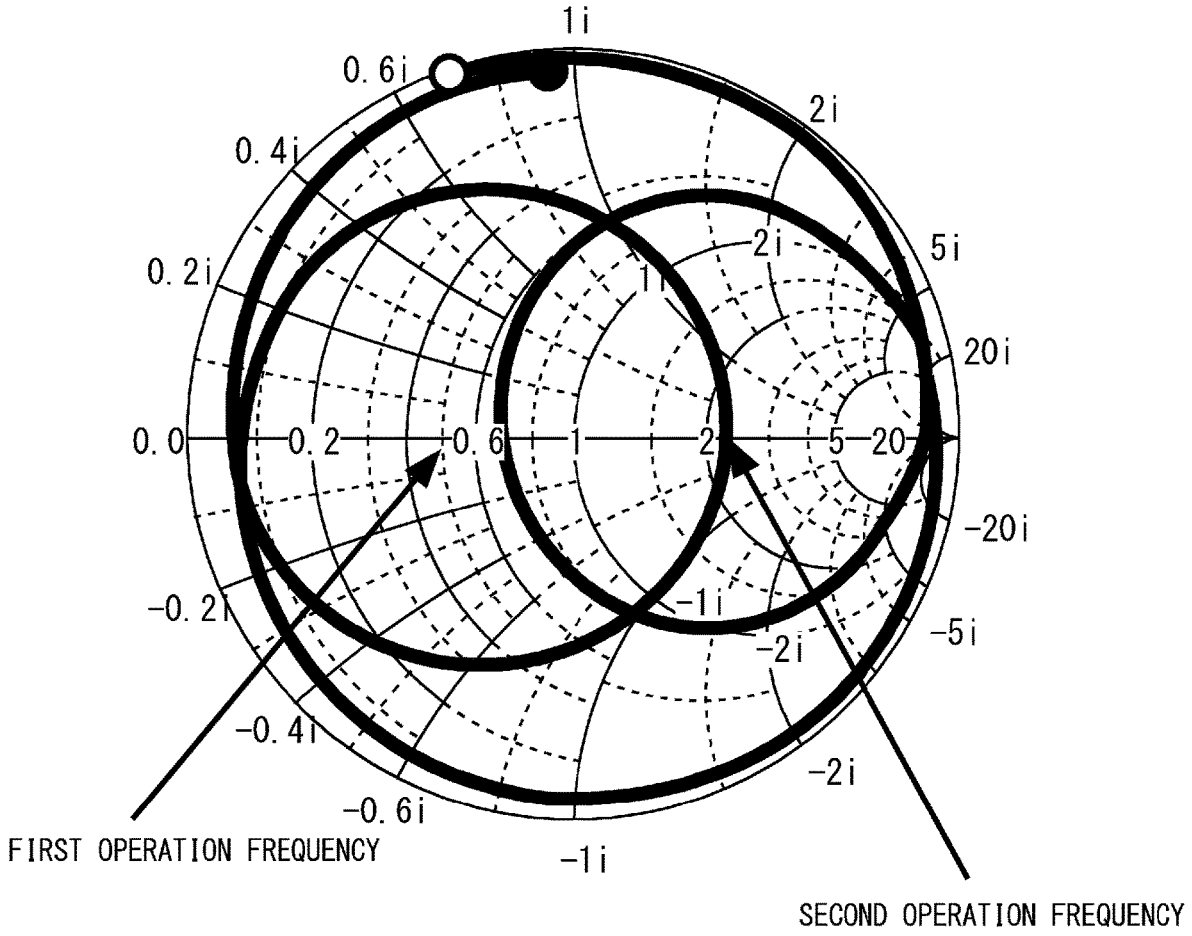
FIG. 10 is a Smith chart showing an example of an impedance characteristic of the SRR antenna of the antenna device shown in FIG. 7.
Figure 11:
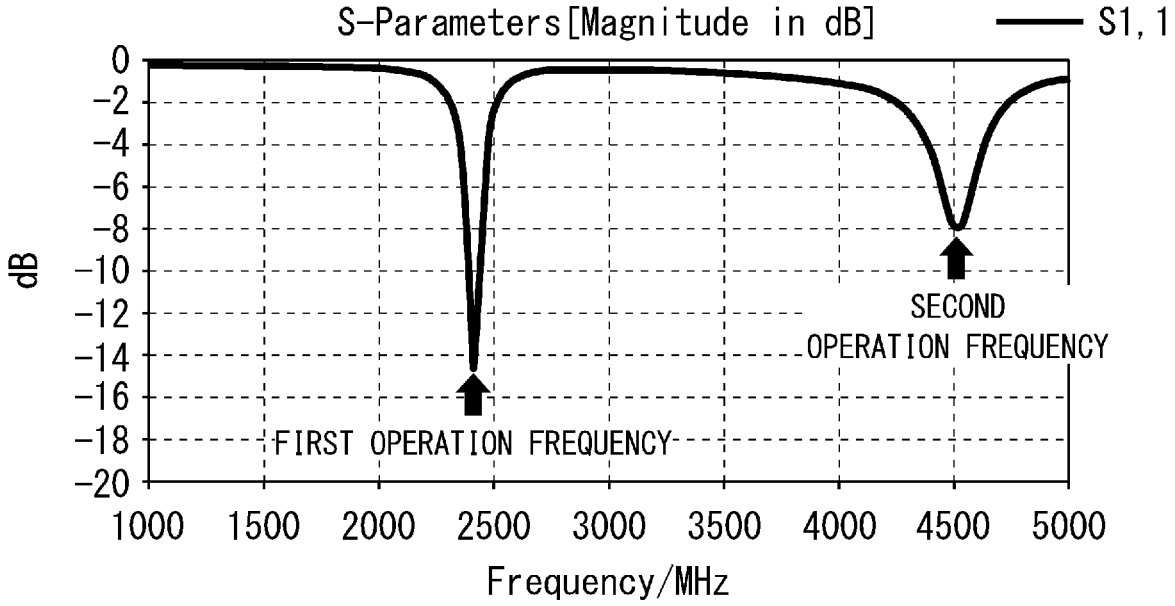
FIG. 11 is a characteristic diagram showing an example of a return loss characteristic of the SRR antenna of the antenna device shown in FIG. 7.
Figure 12:
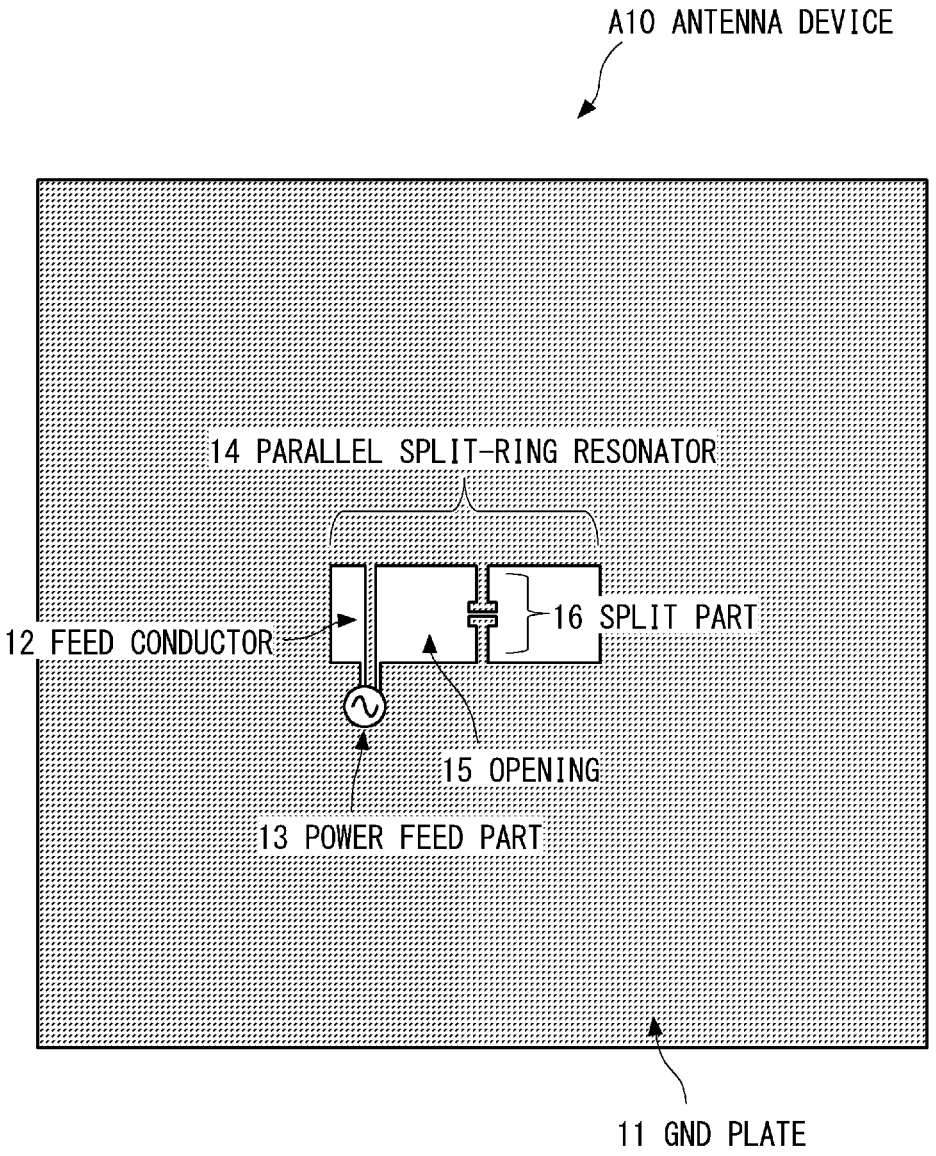
FIG. 12 is a conceptual diagram showing a configuration example of an antenna device in a related technique.
Figure 13:
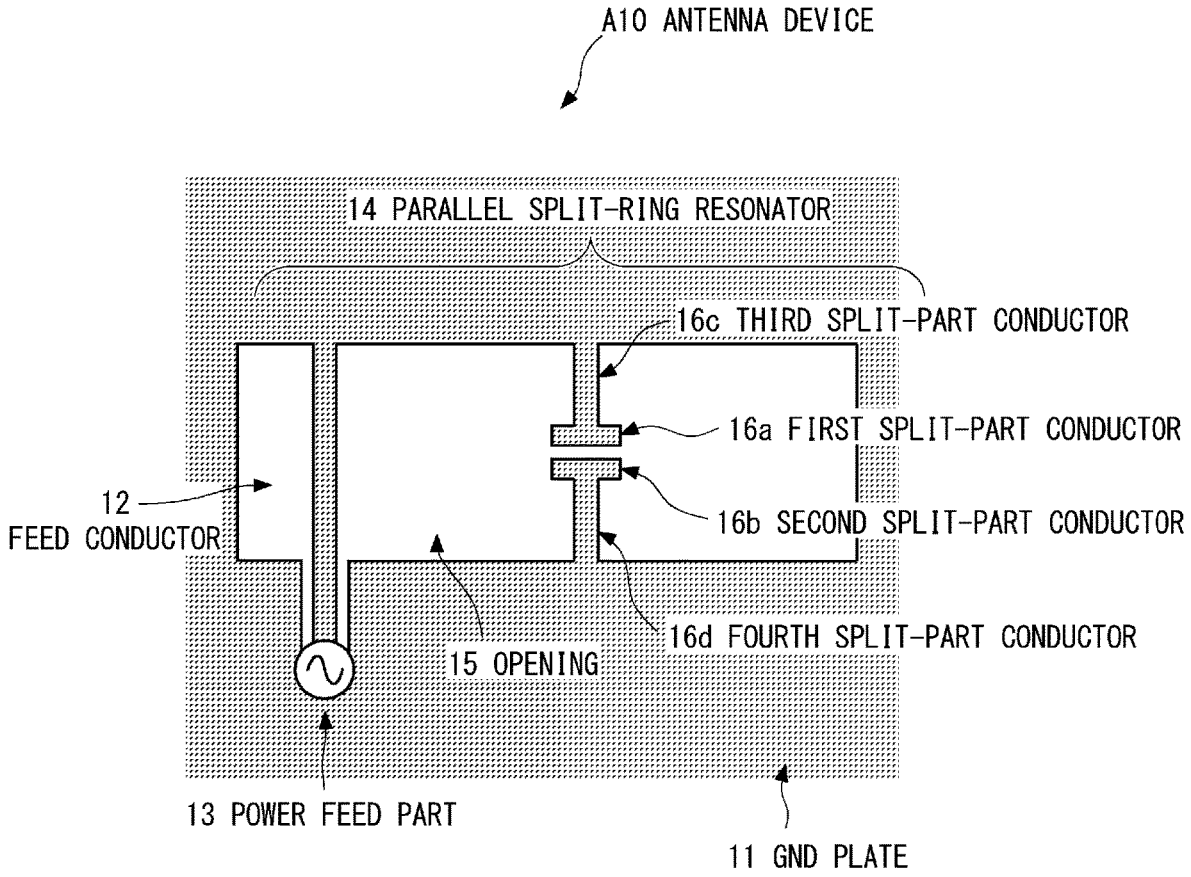
FIG. 13 is an enlarged view of a parallel split-ring resonator provided to the antenna device shown in FIG. 12.
Figure 14:
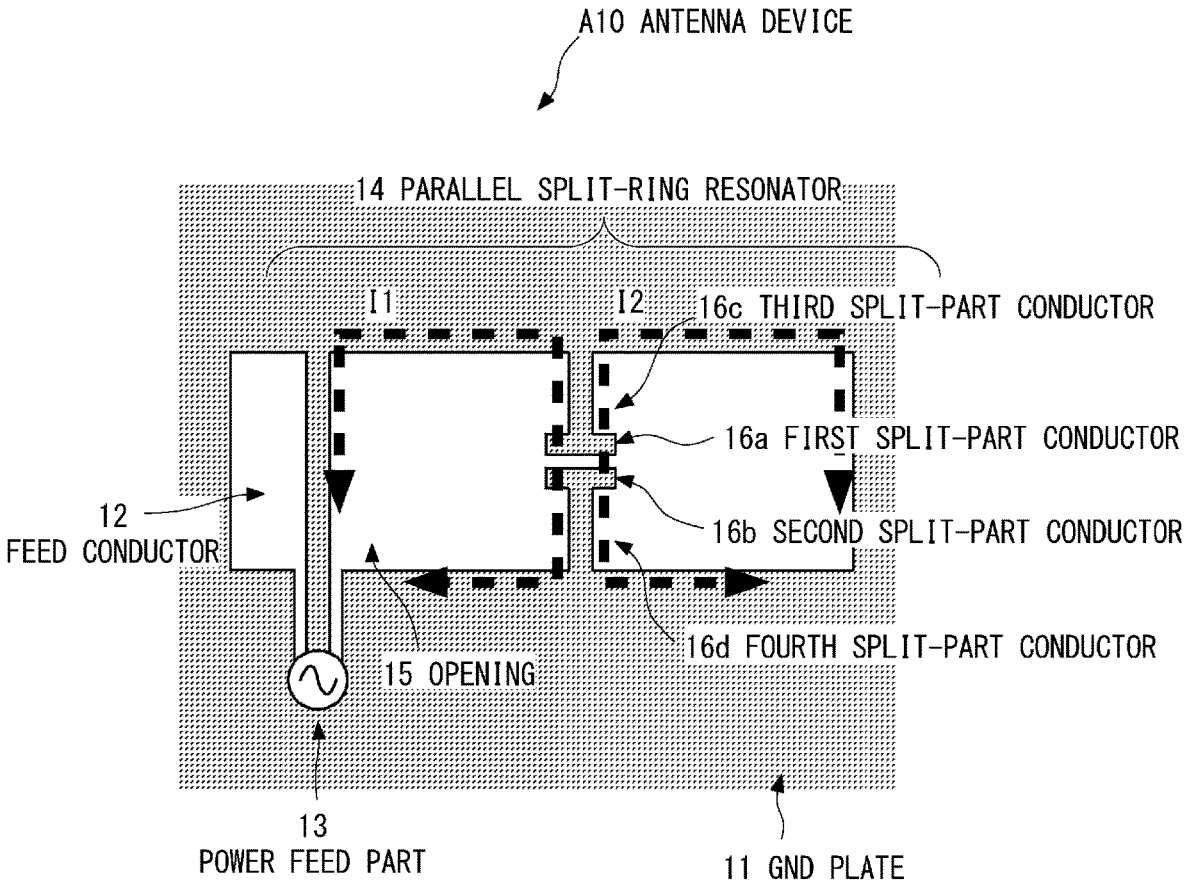
FIG. 14 is a schematic diagram showing a current flow at an operation frequency of an SRR antenna of the antenna device shown in FIG. 12.
Figure 15:
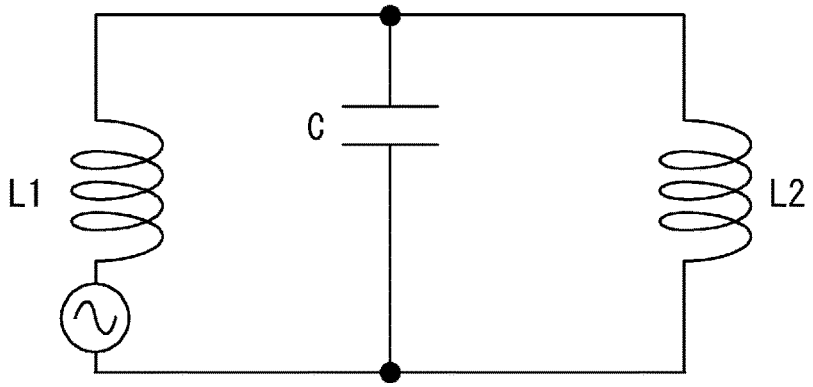
FIG. 15 is a circuit diagram showing an equivalent circuit of the parallel split-ring resonator provided to the antenna device shown in FIG. 12.
Figure 16:
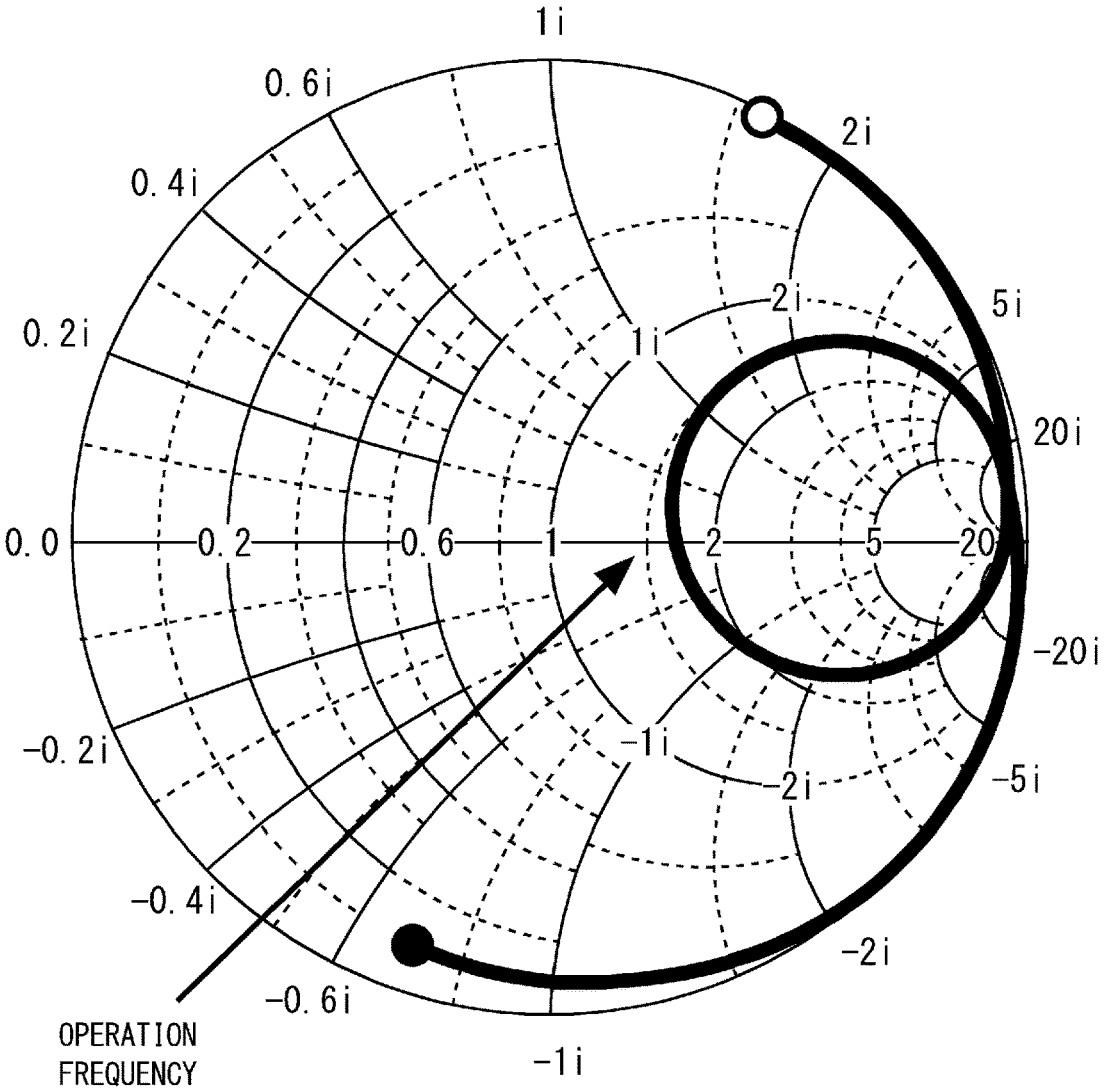
FIG. 16 is a Smith chart showing an example of an impedance characteristic of the SRR antenna of the antenna device shown in FIG. 12.
Figure 17:
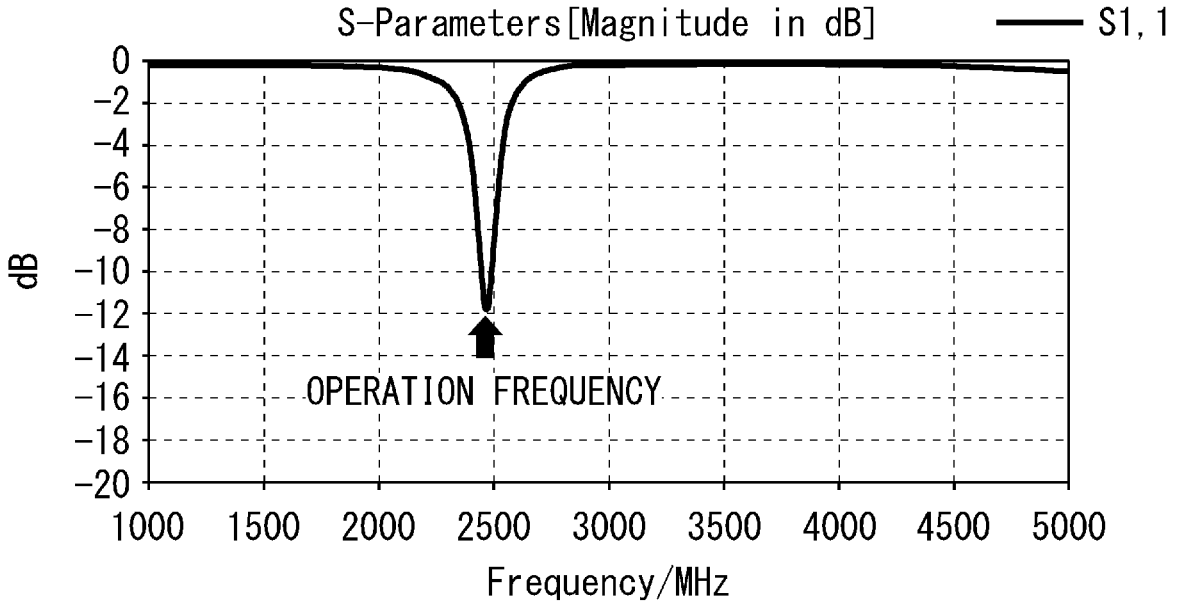
FIG. 17 is a characteristic diagram showing an example of a return loss characteristic of the SRR antenna of the antenna device shown in FIG. 12.

FIG. 10 is a Smith chart showing an example of an impedance characteristic of the SRR antenna of the antenna device A2. FIG. 11 is a graph showing an example of a return loss characteristic of the SRR antenna of the antenna device A2. The descriptions for FIGS. 10 and 11 are basically similar to those for FIGS. 5 and 6, and is omitted.

As described above, in the antenna device A2 according to the second example embodiment, the SRR antenna is configured by forming a plurality of parallel split-ring resonators inside the GND plate 1, similarly to the antenna device A1. Thus, it is possible for the antenna device A2 to have an effect equivalent to that of the antenna device A1. As the result, it is possible for, for example, a radio apparatus mounting the antenna device A2 to be downsized, and to perform radio communication in accordance with a plurality of communication standard.

As described above, in the antenna device according to the above first and second example embodiments, the SRR antenna is constituted by forming a plurality of parallel split-ring resonators inside the GND plate 1. Thus, it is possible for the antenna device according to the above first and second example embodiments to arrange the SRR antenna at any available region of the GND plate 1, and to be downsized. Furthermore, it is possible for the antenna device according to the above first and second example embodiments to transmit and receive radio signals in a plurality of frequency bands (communication bands). In other words, it is possible for the antenna device according to the above first and second example embodiments to operate at a plurality of frequencies. Note that, the operation frequencies are adjustable individually. As the result, it is possible for a radio apparatus mounting such an antenna device to be downsized, and to perform radio communication in accordance with a plurality of communication standards.

The disclosure made by the inventors has been described concretely based on the example embodiments, but the present disclosure is not limited to the above example embodiments, and various modifications can be made without departing from the scope.

According to the above example embodiments, it is possible to provide an antenna device and a radio apparatus capable of performing radio communication in a plurality of frequency bands.

The first and second example embodiments can be combined as desirable by one of ordinary skill in the art.)

While the disclosure has been particularly shown and described with reference to example embodiments thereof, the disclosure is not limited to these example embodiments. It will be understood by those of ordinary skill in the art that various changes in form and details may be made therein without departing from the spirit and scope of the present disclosure as defined by the claims.

What is claimed is:

1. An antenna device comprising:

a first parallel split-ring resonator; and a second parallel split-ring resonator, wherein the first parallel split-ring resonator comprises:

a first opening formed inside an earth plate;

a first feed conductor formed, in an opening region of the first opening, from a first outer peripheral side, the first outer peripheral side being one of outer peripheral sides of the first opening, to a second outer peripheral side facing the first outer peripheral side, and supplied with AC power from the first outer peripheral side; and a first split part formed in the opening region of the first opening, the second parallel split-ring resonator comprises:

a second opening formed inside the earth plate;

a second feed conductor formed, in an opening region of the second opening, from a third outer peripheral side, the third outer peripheral side being one of outer peripheral sides of the second opening, to a fourth outer peripheral side facing the third outer peripheral side, and supplied with the AC power from the third outer peripheral side; and a second split part formed in the opening region of the second opening, the first split part comprises:

a first split-part conductor arranged so as to face a part of a first current path formed by a part of the outer peripheral sides of the first opening and the first feed conductor; and a second split-part conductor connecting the first split-part conductor to another part of the first current path, and the second split part comprises:

a third split-part conductor arranged so as to face a part of a second current path formed by a part of the outer peripheral sides of the second opening and the second feed conductor; and a fourth split-part conductor connecting the third split-part conductor and another part of the second current path.

2. The antenna device according to claim 1, wherein the first split-part conductor is arranged in the opening region of the first opening so as to face the first feed conductor, and the third split-part conductor is arranged in the opening region of the second opening so as to face the second feed conductor.

3. The antenna device according to claim 2, wherein the first split-part conductor is adjusted in such a manner that a side facing the first feed conductor has a first predetermined width, and the third split-part conductor is adjusted in such a manner that a side facing the second feed conductor has a second predetermined width.

4. The antenna device according to claim 2, wherein the first split-part conductor and the first feed conductor are adjusted so as to have a first predetermined distance therebetween, and the third split-part conductor and the second feed conductor are adjusted so as to have a second predetermined distance therebetween.

5. The antenna device according to claim 1, wherein the first split part further comprises:

a fifth split-part conductor arranged so as to face the first split-part conductor; and a sixth split-part conductor arranged so as to connect the fifth split-part conductor to the first current path, and the second split part further comprises:

a seventh split-part conductor arranged so as to face the third split-part conductor; and an eighth split-part conductor arranged so as to connect the seventh split-part conductor to the second current path.

6. The antenna device according to claim 5, wherein the first split-part conductor and the fifth split-part conductor are adjusted in such a manner that respective facing sides each have a first predetermined width, and the third split-part conductor and the seventh split-part conductor are adjusted in such a manner that respective facing sides each have a second predetermined width.

7. The antenna device according to claim 5, wherein the first split-part conductor and the fifth split-part conductor are adjusted so as to have a first predetermined distance therebetween, and the third split-part conductor and the seventh split-part conductor are adjusted so as to have a second predetermined distance therebetween.

8. The antenna device according to claim 1, wherein the first current path is adjusted so as to have a first predetermined length, and the second current path is adjusted so as to have a second predetermined length different from the first predetermined length.

9. The antenna device according to claim 1, wherein a third path enclosing, of the opening region of the first opening, an opening region different from an opening region enclosed by the first current path is adjusted so as to have a third predetermined length, and a fourth path enclosing, of the opening region of the second opening, an opening region different from an opening region enclosed by the second current path is adjusted so as to have a fourth predetermined length.

10. A radio apparatus comprising the antenna device according to claim 1.

* * * * *